United States Patent [19]

Shevick et al.

[11] Patent Number: 4,973,183

[45] Date of Patent: Nov. 27, 1990

[54] ORIGINAL CONTAINER-APPLICATION DEVICES

[75] Inventors: Philip Shevick, 525 Grove St., Evanston, Ill. 60201; Kenneth Wilkinson, Round Lake, Ill.

[73] Assignee: Philip Shevick, Evanston, Ill.

[21] Appl. No.: 504,936

[22] Filed: Apr. 5, 1990

Related U.S. Application Data

[63] Continuation-in-part of Ser. No. 330,647, Mar. 30, 1989.

[51] Int. Cl.[5] ..... B05C 5/02

[52] U.S. Cl. ..... 401/278; 401/28; 222/510; 222/518; 222/453

[58] Field of Search ..... 401/282, 279, 290, 278, 401/131, 4, 28; 137/614.21, 627.5; 222/510, 518, 453, 449, 213, 365, 476, 425; 251/320, 321, 322; 132/115, 116

[56] References Cited

U.S. PATENT DOCUMENTS

| | | | |
|---|---|---|---|
| 470,461 | 3/1892 | Banta | 401/278 |
| 785,094 | 3/1905 | Friborg | 222/453 |
| 1,698,732 | 1/1929 | Pasnik | 222/510 |
| 1,763,832 | 6/1930 | Taylor | 401/279 |
| 2,636,203 | 4/1953 | Glantz | 401/278 |
| 2,661,874 | 12/1953 | Appell | 222/453 |
| 2,734,773 | 2/1956 | Ivins | 251/320 |
| 3,666,150 | 5/1972 | Liljeholm | 222/453 |
| 3,731,851 | 5/1973 | Rauh | 222/469 |

FOREIGN PATENT DOCUMENTS

| | | | |
|---|---|---|---|
| 24529 | 12/1930 | Australia | 401/278 |
| 3006463 | 9/1981 | Fed. Rep. of Germany | 401/279 |

*Primary Examiner*—Richard J. Johnson
*Attorney, Agent, or Firm*—Walter C. Ramm

[57] ABSTRACT

An original container-applicator device for relatively viscous preparations, such as and of the consistency of hair shampoos and conditioners. Provided with a supply of such a preparation, the device functions as the original container until, in the hands of the ultimate consumer, it serves also as the applicator. The device comprises a chamber; massage fingers, an outlet or dispensing port, as defined by an elongate rim with a proximal end and a distal end; and, a reciprocative valve. The valve has a flange and a gate, and moves between first and second positions. At the first position, the gate closes the distal end while the valve leaves the proximal end open and enables the preparation from the chamber to fill the rim, but not flow from the device. At the second position the flange closes the proximal end and prevents flow from the chamber, while the gate is displaced from and leaves the distal end open, thus to enable a quantity of preparation to flow or drain from the rim, and be dispensed. The valve may be embodied as a substantially rigid member in which case a portion of the device deforms and then resiliently resumes original conformation as the valve moves between the first and second positions. Alternatively, the valve may be embodied with a flexile and resilient frusto-conical hinge portion which enables "over center hinge action" as the valve moves between the first and second positions and whereby most of the deformation attending the movement occurs in the hinge portion, and the body is relatively undeflected. Some of the fingers hinge the rim.

10 Claims, 2 Drawing Sheets

Fig. 8A
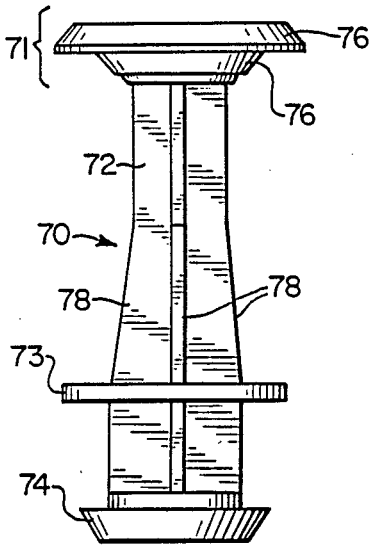
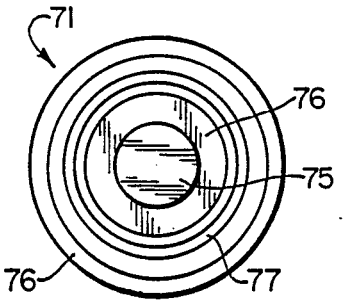
Fig. 8B
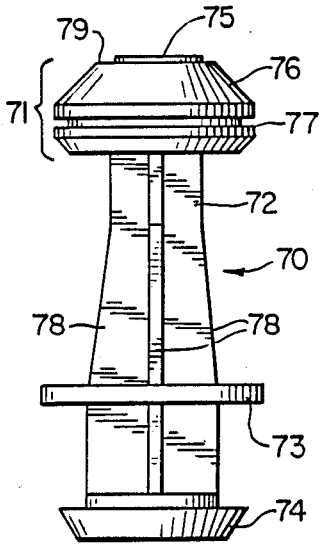
Fig. 9
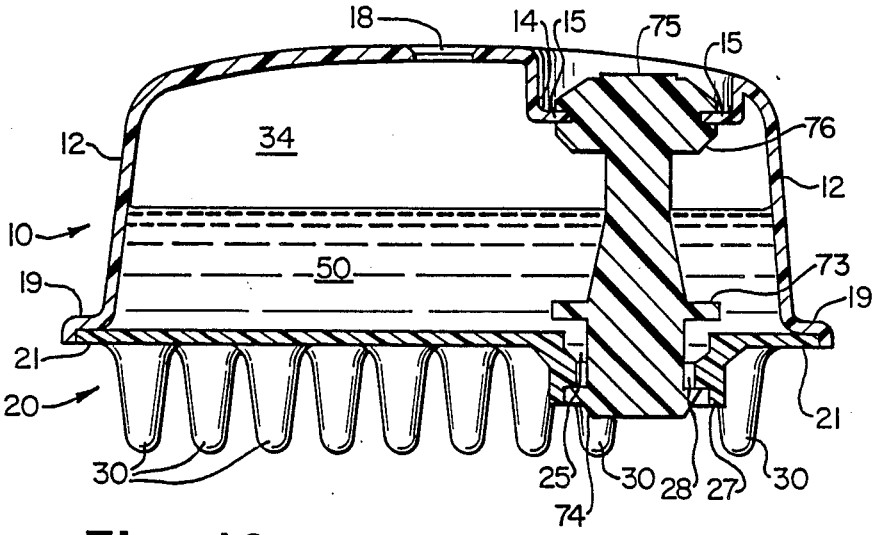
Fig. 10
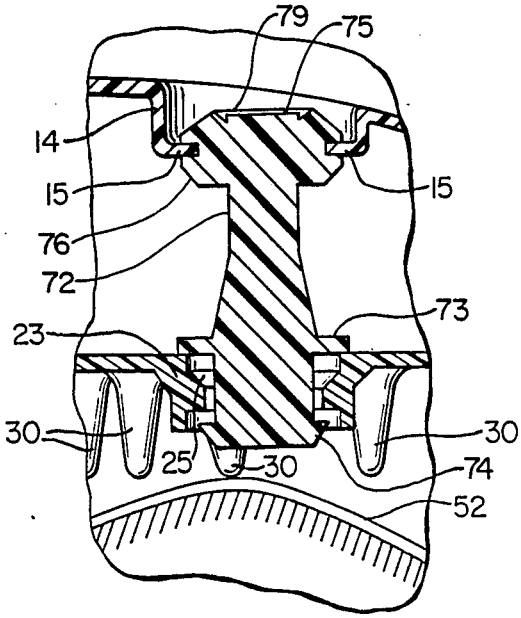
Fig. 11

ORIGINAL CONTAINER-APPLICATION DEVICES

This application is a continuation-in-part of pending U.S. application Ser. No. 330,647, filed Mar. 30, 1989.

BACKGROUND OF THE INVENTION

FIELD OF THE INVENTION

This invention pertains to original container-applicator devices for applying or delivering relatively viscous preparations to a human or animal body, and includes a self-contained valve. As made, such a device is charged with such a substantial volume of such a preparation, and may be fitted with a closure, and the contained formulations thus protected against leakage or unwanted loss.

SUMMARY OF THE INVENTION

Generally, this invention provides, as a single unit, an original-container applicator device to contain, dispense and apply relatively viscous human- or animal-use products, and to make the contained product directly and immediately available for topical application or administration. Examples of such a product are hair shampoos, hair conditioners, medicated or medicinal preparations whereof an anti-microbial or keratolytic agent, or a substance such as selenium sulfide or hyrdocortisone (as may be indicated in the treatment of seborrhea) is an active ingredient, and the like. Such products usually have several ingredients; in this specification, any such product (without regard to the number of ingredients) is referred to as a "formulation" and several such products are collectively called "formulations."

One object of this invention is, by a convenient and cost-effective device, to overcome the need for respective (i) supply or storage containers, such as the containers in which formulations are sold to end-use customers in retail outlets and (ii) discrete immediate-use devices, such as applicators, which the user might attach to the supply container or otherwise provide. Therefore, the device has an outer size which enables it easily to be hand-held by a user, and an interior capacity for a worthwhile volume of to-be-applied formulation. The device defines a port. The device and its components are well-adapted to automated high-speed assembly and fill operations.

Another object of this invention is reliably to dispense a formulation from an original container-applicator device. Thus, the invention provides a novel self-contained dispensing valve to control its outlet in ordinary, at-home situations of use. The valve has an exterior actuating means, and each actuation of the valve is meant to deliver a substantially uniform quantity of formulation.

A still further object of this invention is to protect the contents of such an original container-applicator device from unwanted loss or depletion in special circumstances such as, for example, shipment of filled devices from the place of filling to the point of sale or, after purchase by the ultimate customer, jostling or barometric changes incidental to the user's personal travel. Therefore, apart from the valve, the device also is adapted to have a shipping or storage closure. Application-assisting features, such as elongate massage fingers, on the bottom of the device may hedge the outlet.

BRIEF DESCRIPTION OF THE DRAWINGS

FIGS. 8A–8B show an alternative valve for the device in an initial or "as molded" conformation. FIG. 8A is an elevation view of the alternative valve. FIG. 8B is a plan view of the valve in FIG. 8A.

FIG. 9 is an elevation view of the alternative valve of FIG. 8A, but with the hinge-element thereof partially turned from the "as molded" to the "install" or everted first conformation.

FIG. 10 is a side elevation sectional view of the assembled device, similar to FIG. 6 and taken as along line 6—6 of FIG. 1, with the alternative valve as installed and in the everted first conformation. The gate of the alternative valve is in a closing position.

FIG. 11 is a partial side-sectional view, similar to FIG. 7 and corresponding to the view of FIG. 10, wherein the gate of the alternative valve is open while the flange thereof is in a closing position with reference to the device.

DESCRIPTION OF THE PREFERRED EMBODIMENT

Figure 1:
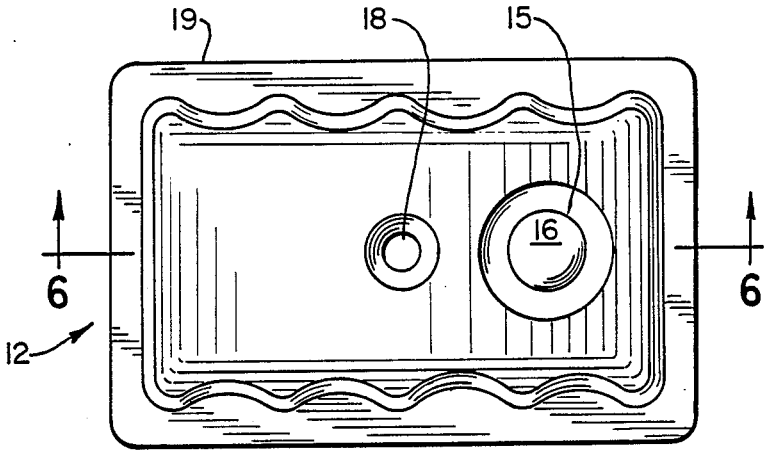
FIG. 1 is a top plan view of the body of the original container-applicator device of the present invention.
Figure 2:
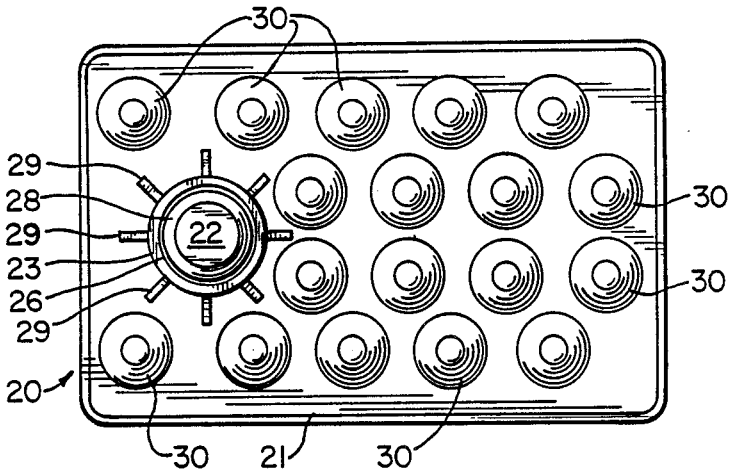
FIG. 2 is a plan view of the bottom of the said device, as looking upward when the device is in usual orientation.
Figure 3:
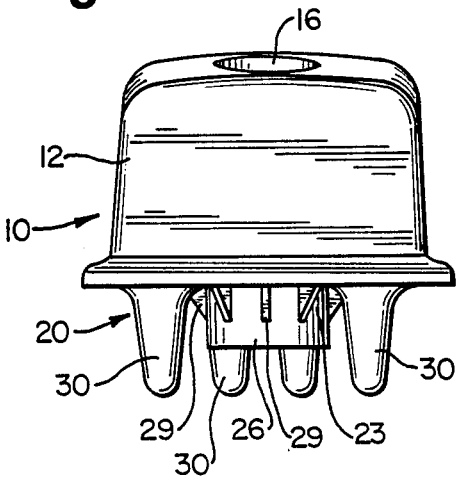
FIG. 3 is a right end elevation view of the body of FIG. 1 and the bottom member of FIG. 2 joined together.
Figure 4:
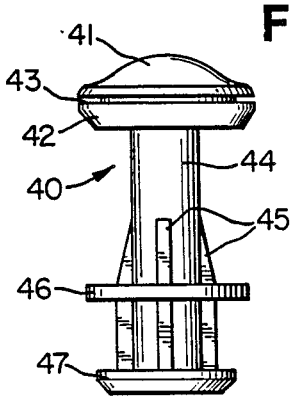
FIG. 4 is an elevation view of the valve of the said device.

FIGS. 1–7 show a preferred embodiment of the original container-applicator device of this invention, and the structural components and operational aspects of the device. Reference numerals identify the components or aspects, as follows: numeral 10 is the device, 12 is the body of device 10, 14 is a shoulder in body 12, 15 is the circular lower edge portion of shoulder 14, 16 is a circular first or "valve" aperture defined by edge 15, 18 is a circular second or "fill" aperture in body 12, 19 is the lower edge portion of body 12, 20 is the bottom of device 10, 21 is the base portion of bottom 20, 22 is an "outlet" port in base 21, 23 is an elongate rim extending from base 21, 24 is the upper or proximal end of rim 23 that circumscribes port 22, 25 is the outlet channel of device 10 as defined by rim 23, 26 is the lower or distal end of rim 22, 27 is a lip at end 26, 28 is an interior throat portion portion or rim 23, 29 is each of several ribs intermediate base 21 and rim 23, 30 is each of several massage fingers extending from base 21, 32 is each of several arcuate fitting guides on base 21, 34 is the interior chamber of device 10, 36 is a plug for aperture 18, and 38 is a optional demountable closure for end 26.

Also, numeral 40 is the valve of device 10, 41 is buttom-cap of valve 40, 42 is the lower portion of cap 41, 43 is a circumferential groove in portion 42, 44 is the stem of valve 40, 45 is each of several radial rib elements comprising stem 44, 46 is the flange of valve 40, 47 is the gate of valve 40, 50 represents a formulation in device 10, and 52 is the surface onto which formulation is dispensed.

Particular shapes and conformations of the structural components of and for device 10, as shown in the drawings, contribute notably to its proper construction and function. Plug 36 and cap 41—each being circular and, as illustrated, circumferentially grooved—preferably are snap-in elements. Therefore, dimensions and dimensional tolerances and allowances of components or parts which are to be inserted, matched, or held are matters of importance. Having regard for such matters and the exemplary materials hereinafter disclosed, body 12, bottom 20, plug 36, closure 38 and valve 40 may be made of well-known materials and by conventional methods such as injection molding.

Shoulder 14 and flexile fingers 30 are resilient elements; they are required, in response to an applied actuating force, to yield from original conformation, and, in the absence of the force, to retain or quickly to resume the original conformation. Preferably, shoulder 14 is unitary with body 12, and fingers 30 are unitary with and base 21. Accordingly, the material for body 12 and bottom 20 has resilient properties; an exemplary such material—well-known to the plastics fabrication art—is flexible polyvinyl chloride (PVC) GEON 86154. Fabrication of the body and the bottom, in details such as wall-thickness and material-thickness, must likewise respond to a yield and re-form requirement. Wall-thicknesses need not be greater than is necessary for structural integrity and reliably to contain the formulation; in the preferred embodiment, with the said exemplary material, the nominal wall-thickness of body 12 and bottom 20 is 0.04 inch.

FIGS. 1–4 illustrate characteristic elements of the preferred embodiment. Body 12 has opposed side- and end-walls comprising a wall portion, an upper portion or top, and shoulder 14 formed therein. Edge 19 surrounds the lower portions of such side and end surfaces of body 12. Rim 23 depends from base 21, and ribs 29 contribute to the rigidity of the rim relative to the base.

Fingers 30 also depend from base 21 and are longer than than rim 23 and terminate substantially beyond end 26, and several of the fingers hedge the larger portion of the rim's perimeter. As is common with massage fingers intended to flex in the application of, for example, a hair-care formulation, fingers 30 are hollow. The hollowness imparts a larger capacity than article with the same dimensions as device 10 but with solid fingers.

Valve 40 is an elongate unitary member with a grooved button-cap 41 at its upper end and gate 47 at its lower end, and flange 46 between. The separation between flange 46 and gate 47 is greater than the length of rim 23. Valve stem 44 is a substantially rigid element, and radial ribs 45 contribute to such rigidity. Nevertheless, as snap-in or snap-through elements, cap 41, flange 46 and gate 47 are in some measure resilient. An exemplary material for valve 40—likewise well-known to the plastics fabrication art—is Shell Kraton G-2705.

Figure 5:
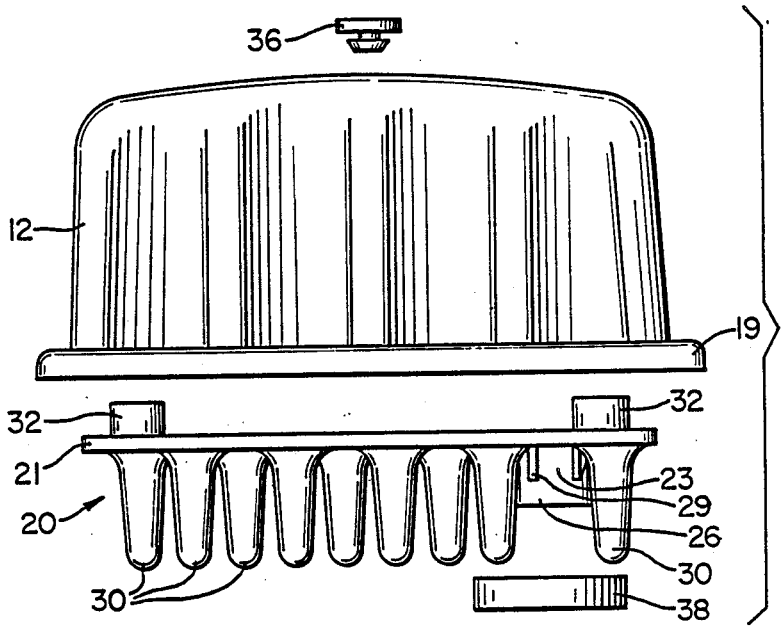
FIG. 5 is an exploded elevational view of the body, the bottom, and the fill-port plug comprising the said device, and including a closure for the rim of the outlet port of the bottom.
Figure 6:
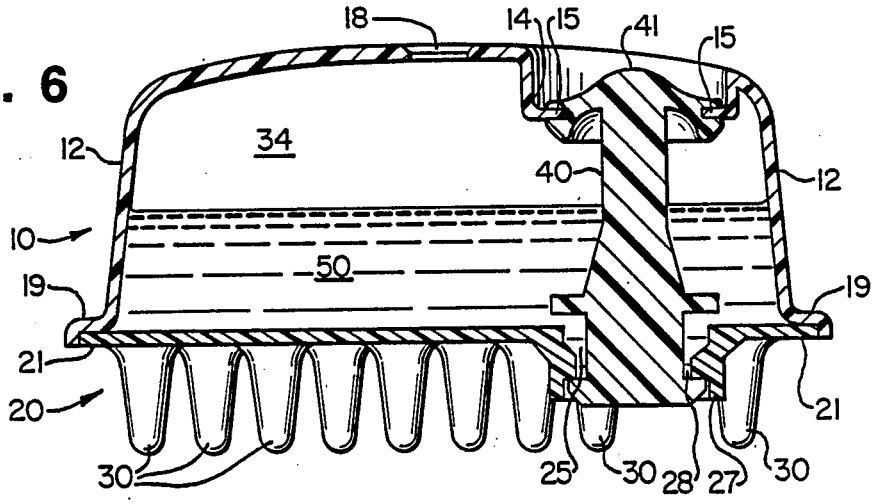
FIG. 6 is a side elevation sectional view of the assembled device, taken as along line 6—6 of FIG. 1, and including the valve of FIG. 4, as installed. The gate of the valve is in a closing position.

FIG. 5 and FIG. 6 further illustrate device 10, respectively, as an exploded side view of the unassembled (and unfilled) device, and as a sectional view of the same side of an assembled operative device. FIG. 1 shows that valve aperture 16 is circular.

Four principal steps are involved in the assemblage of FIG. 6. First, body 12 and bottom 20 are joined, with base 21 within edge 19 and guides 33 contributing to the proper mutual dispostion of the two pieces. This joinder may be by radio frequency (RF) welding (with an appliance adapted to the shape, such as the surface around which edge 19 and bottom 20 join) or by an adhesive. For the exemplary material and indicated wall-thicknesses, the RF welding frequency is less than 1,000 kilohertz with a dwell time of 1–2 seconds. An exemplary adhesive for the purpose is ethylene dichloride. The thus-joined pieces comprise the principal sub-assembly of device 10, and in this sub-assembly, aperture 16 and rim 23 are co-axial.

Second, valve 40 is inserted, with gate 47 first and via aperture 16, into the body 12/bottom 20 sub-assembly, and snapped into connection therewith by engagement of circular edge 15 in circumferential groove 43. Gate 47 and ribs 29 may be tapered in aid of this insertion and snap-into connection. Conformation of shoulder 14 and the length of valve 40 are such that, in the insertion, edge 15 and cap 41 form a formulation tight-seal, shoulder 14 yields and deforms inwardly and, then, when and as the shoulder resumes a first unforced or unyielded position, gate 47—having passed through bottom 20 and out of rim 23—is external of and bears on throat 28, is within lip 27 and tightly closes end 26; and, also, flange 46, within cavity 31, is above and spaced from port 22.

Next, the body 12/bottom 20 sub-assembly, as valved and with gate 47 closing end 26 and rim 23, is charged, via fill aperture 18, with a quantity of formulation 50. Typically, for this filling, the sub-assembly is in an upright position so the formulation may flow under gravity in the cavities of fingers 30 and, as well, into chamber 34 and rim 23. This filling step is readily adaptable to rapid, standard-volume and highly automated techniques.

Fourth and finally, plug 34 is snapped into fill aperture 18, and engages with the top of body 12 to comprise, likewise, a formulation-tight seal, and device 10 is complete.

Closure 38 may be optionally provided for end 26, when and as closed by gate 47, additionally to guard against inadvertent loss of formulation 50 on account of jostling or barometric changes. With or without closure 38, several fingers 30 at least partially hedge rim 23 also protect against unwanted disturbance of gate 47.

Figure 7:
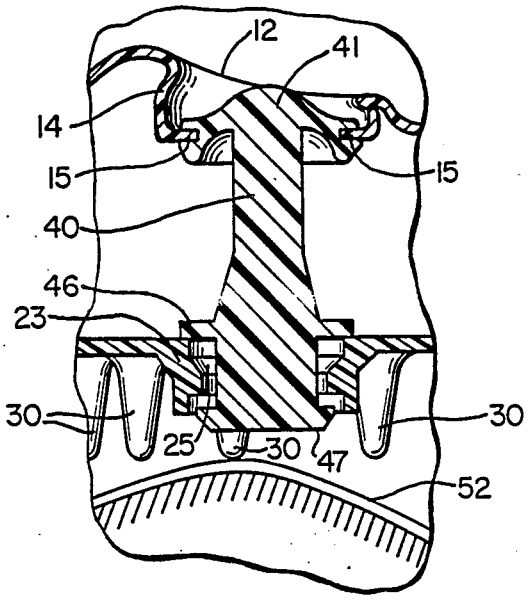
FIG. 7 is a partial side-sectional view, corresponding to the view of FIG. 6, wherein the gate of the valve is open while the flange of the valve is in a closing position with reference to the device.

Device 10, filled and fully-assembled, is ready for manual operation by a user. FIGS. 6 and 7 illustrate such operation with valve 40, which may be described as a downward-upward or two-stroke cycle of valve 40. Preliminarily, if a closure 38 is provided, the user removes it. Also, device 10 is in a generally upright posture and, typically, with fingers 30 on or otherwise positioned slightly above the body part or other surface 52 to which formulation 50 is to be applied. Shoulder 14 and valve 40 begin at and from the unforced or unyielded first position of FIG. 6.

The user then grasps the device and, by her/his own finger, exerts downward actuating force against cap 41. This force initiates the downward stroke of the cycle, causes shoulder 14 to deform or flex inwardly, and moves valve 40 downwardly relative to the other parts of the device and gate 47 from its closing position relative to port 22. The maximally open position of valve 40, formulation 50 flows via now-open end 26, from rim 23 and is dispensed onto surface 52, and also from cavity 34, via now-open port 22, into rim 23.

As the user maintains force, the downward stroke continues. Flange 46 approaches and reaches port 22, and then, seating upon and stopped by end 24, serves to close port 22. The downward stroke is thus completed. During the stroke, fingers 30 served to space gate 47 from surface 52 so that the surface does not interfere with the gate's described displacement.

With completion of the downward stroke, shoulder 14 attains the second or maximally-yielded position shown in FIG. 7. The user may briefly maintain the force, allowing any amount of formulation 50 yet in rim 23 to drain past the still-unclosed gate 47. The dimension of movement of valve 40 between the first and second positions may be characterized as a stroke-length.

The user then releases the actuating force, and the resilience of shoulder 14 serves quickly to restore the shoulder to its original unyielded conformation and to return valve 40, through an upward reciprocal stroke, to the first position and to complete one operating cycle. Flange 46 no longer closes port 22, but gate 47 again closes end 26. A typical and desired time for such restoration—from the second to the first position—is 1 second, notably less than is required for the viscous formulation to pass closing gate 47. The indicated exemplary materials and specified wall-thicknesses are consistent with this desired restoration time.

The quantity of formulation 50 dispensed during an operating cycle is related to the volume of rim 23. Because of the short stroke-length and the brief time required therefor, the period the gate is open is not subject to wide variation either with reference to the same user or as between different users of a device 10. Accordingly, such time period influences the quantity dispensed, if at all, only in minor degree. A typical quantity is 2.5 milliliters (ml); allowing for the displacement of the portions of valve 40 within rim 23, the rim should have sufficient volume or capacity to accommodate the typical quantity.

After the user dispenses the formulation, she/he then continues to use device 10 and, particularly, its massage fingers, to complete the application of the formulation.

The illustrated preferred embodiment of device 10 may have these exemplary dimensions in inches body 12: length, 4.312; width, 2.784; and, maximum height, 1.750;

base 21: length, 4.212, and width, 2.684;

finger 30: length, 0.875, and, over its mid-portion, outer diameter, 0.313;

rim 23: length (from proximal end 24 to lip 27), 0.430; maximum internal diameter, 0.875; and, throat diameter, 0.75;

valve 40: overall length, 2.12, and distance separating flange 46 and gate 47, 0.44;

button 41: maximum diameter, 1.05 inches, diameter at groove 43, 0.89, and width of groove 43, 0.03;

aperture 16: diameter, 0.875 (that is, slightly smaller than the diameter of groove 43); and, aperture 18: diameter, 0.38.

DESCRIPTION OF ALTERNATIVE PREFERRED EMBODIMENT

FIGS. 8A–8B and 9 depict an alternative type of valve for an original container-applicator device, and FIGS. 10–11 depict an alternative preferred embodiment of the device with a valve of the thus-depicted alternative type. This alternative valve is adapted—in a phase from the terminology of the plastics fabrication art—for "over center hinge action"; hereafter in this specification the letters "OCHA" abbreviate that phrase, and the alternative valve is sometimes called an "OCHA valve".

FIGS. 8A–8B and 9–11 utilize the same reference numerals as FIGS. 1–3 and 5–7 in connection with device of the present invention and these additional numerals for the said alternative preferred embodiment: 70 is the OCHA valve; 71 is the actuating-member, 72 is the stem, 73 is the flange, and 74 is the gate—all of valve 70; 75 is the button, 76 is the hinge-portion, and 79 is a circular hinge-line—all of member 71; 77 is a circular groove in portion 76; and, 78 is each of several radial rib elements comprising stem 72.

Valve 70 is an elongate unitary piece with member 71 comprising button 75 and frusto-conical hinge-portion 76 at the valve's upper or first end, and gate 74 at its lower or second end. These upper-end features are unlike those of valve 40, for, rather than cap 41, portion 76 provides a resilient 360° hinge. Valve 70 with evertable portion 76, as in FIG. 8A, may be readily made by conventional injection molding techniques. An exemplary material for valve 70 is Shell Kraton G-2705;

Valve 70 is further characterized in these particulars: Flange 73 is between button 75 and gate 74. The separation between flange 73 and gate 74 is greater than the length of rim 23. Stem 72 is a substantially rigid element, and ribs 78 may contribute to the rigidity. Flange 73 and gate 74, as snap-in or snap-through elements, are in some measure resilient. Portion 76 is flexile and resilient so that, as hereinafter described, it may be everted to enable engagement between valve 70 and the body 12/bottom 20 sub-assembly, and, when the valve and the sub-assembly are engaged, and depressing force is applied to button 75, portion 76 is adapted to yield and, in the absence of such force, to retain or quickly to resume unyielded conformation.

Eversion of member 71 is a partial folding down and over, or turning inside out, of portion 76, from the "as molded" shape of FIG. 8A to the "install" or everted first conformation of FIG. 9. The eversion, in effect, rotates groove 77 by some 90° and around a 360° perimeter from the upward disposition of FIG. 8B to the substantially coplanar and outward disposition of FIG. 9. Apart from circumstances attendant upon this eversion, the assemblage of the alternative preferred embodiment involves four steps similar to those disclosed for the embodiment of FIG. 6. First, body 12 and bottom 20 are joined to comprise the sub-assembly as hereinabove described.

Second, valve 70 is installed in the said sub-assembly. Preliminary to installation, portion 76 is subjected to a modest wrapping or similar effect and is slightly and temporarily deformed, from the everted first conformation, to a smaller effective diameter than that of aperture 16. Then, valve 70 is inserted, via aperture 16 and with gate 74 first, into the sub-assembly, and, as the now outward-facing groove 77 approaches co-planarity with edge 15, the wrapping effect is released, and portion 76 resiliently resumes substantially the everted first conformation; also, member 71 snaps into and engages shoulder 14, with edge 15 circumscribing member 71 and well into groove 77, to make a formulation-tight seal. As installed, member 71 and portion 76 are in the everted first conformation, and—except as may be incidental to the engagement—unforced and undeformed.

These eversion and insertion operations may be done by hand or are readily and conventionally adapted to be done by machine.

In aid of the installation, the sizes and circular conformations of edge 15, member 71 and groove 77, as well as the length of stem 72, are such that when valve 70 is installed, gate 74—having passed through bottom 20 and out of rim 23—is external of and bears on throat 28, is within lip 27 and tightly closes end 26; and, flange 73, within cavity 31, is spaced from port 22.

Third, the body 12/bottom 20 sub-assembly, with gate 76 closing end 26 and rim 23, is charged via aperture 18 with formulation 50. And fourth, plug 34 is snapped into body 12 in a formulation-tight seal. Again, closure 38 may be provided, and fingers 30 partially hedge rim 23 to protect gate 74 from unwanted disturbance.

FIGS. 10–11 illustrate the characteristic manual operation of the alternative preferred embodiment as a downward-upward or two-stroke reciprocative cycle with valve 70 providing over center hinge action. Device 10 is generally upright with fingers 30 on or slightly above surface 52. The amount of formulation 50 dispensed in a cycle is related to the volume of rim 23.

The cycle begins with valve 70 in a first position correlative with and defined by portion 76 in the everted first conformation. With the valve in the said first position, the user initiates the downward stroke by exerting a depressing or actuating force, as by a finger, upon button 75. As the user maintains the force, the downward stroke continues; portion 76 flexes and circular hinge-line 79 tends to expand outwardly; stem 72 moves downwardly; gate 74 begins to open; and, as flange 73 approaches and then reaches port 22, the stroke is completed at a second position where, as shown in FIG. 11, the flange is stopped by and seats upon end 24, and closes the port while, concurrently, the gate is fully open. Fingers 30 space gate 74 from surface 52. The displacement of stem 72 between the first and second positions is the stroke-length of valve 70.

This OCHA-valve embodiment differs from the device with valve 40 in that necessary operative flexure is effectively provided by member 71 and, particularly, portion 76, while body 12 and, particularly, shoulder 14 remain relatively undeflected throughout the cycle. Portion 76 is maximally-yielded in the second position at the end of the downward stroke. When the user releases the actuating force, the resilience of portion 76 energizes the reciprocal stroke and return of valve 70 to the first position, thereby completing the cycle, with member 71 having resumed everted first conformation, flange 73 no longer closing port 22, and gate 74 closing end 23. A typical time for this reciprocal stroke is 1 second, and the indicated exemplary materials and wall-thicknesses are consistent with such time.

Other aspects of this alternative preferred embodiment resemble the FIG. 6 embodiment. Again, because of the short stroke-length and brief time required therefor, the period of time gate 75 may be open is not subject to wide variation. At the end of the downward stroke the user may briefly maintain force on button 75, allowing any small amount of formulation 50 yet in rim 23 to drain past open gate 74, and she/he then continues to use the device and its massage fingers to complete application of the formulation. A typical quantity of formulation dispensed in one cycle is 2.5 ml; rim 23 should provide capacity for that quantity.

In the alternative preferred embodiment the exemplary dimensions in inches of body 12, aperture 18, base 21, rim 23, and finger 30 are the same as set forth above; and, correspondingly, aperture 16 has a diameter of 0.875 inch (that is, slightly smaller than the diameter of groove 77 in FIG. 9); and, valve 70 and parts and aspects thereof may have these exemplary dimensions in inches valve 70: overall length in "as molded" conformation (FIG. 8A), 2.320, and distance separating flange 73 and gate 74, 0.44;

member 71: diameter of button 75, 0.375; maximum diameter of hinge-portion 76 (FIG. 8A), 1.219; wall-thickness at hinge-line 79, 0.015; width of groove 77, 0.04.

Many other specific embodiments of an original container-applicator device are within the spirit and scope of this invention.

What is claimed is:

1. A container-applicator device for a relatively viscous formulation, the said device comprising a subassembly defining an interior chamber and including a body having a wall portion, an upper portion with a shoulder, a first aperture circumscribed by the shoulder, and a second aperture, and a bottom joined with the body and having a substantially planar base with a port, a plurality of massage fingers extending from the base, and an elongate rim extending from the base, circumscribing the port, and having a distal end and a throat portion intermediate the port and the distal end;

an elongate valve having a stem with a first end and a second end, a button, with a circumferential groove, at the first end, a gate at the second end, and a flange on the stem intermediate the button and the gate;

wherein the valve engages the shoulder by means of the groove of the button; the button is adapted to be depressed and the shoulder is adapted, when the button is depressed, to move from a first position to a second position and, otherwise, to retain and resiliently to resume the first position; the valve extends from the button and through the rim, and moves with the shoulder between the first and second positions; the gate closes the distal end of the rim when the valve is at the first position; the flange closes the port when the valve is at the second position; and, both the port and the distal end are open when the valve is intermediate the first position and the second position.

2. An article comprising the device of claim 1 where the shoulder is adapted to flex inwardly, the first aperture and the outlet aperture are generally circular and co-axial, the article includes a closure for the second aperture; and, at least some of the fingers are longer than and at least partially hedge the rim.

3. The article of claim 2 comprising also a quantity of formulation in the containment and a demountable closure for the rim.

4. The article of claim 3 where the formulation is a hair-care preparation.

5. The article of claim 3 where the formulation comprises a medicinal preparation.

6. A container-applicator device for a relative viscous formulation, the said device comprising a sub-assembly defining an interior chamber and including a body having a wall portion, an upper portion with a shoulder, a first aperture circumscribed by the shoulder, and a second aperture, and a bottom joined with the body and having a substantially planar base with a port, a plurality of massage fingers extending from the base, and an elongate rim extending from the base, circumscribing the port, and having a distal end and a throat portion intermediate the port and the distal end;

an elongate valve having a stem with a first end and a second end, an acutating member at the first end and providing a button, a flexile and resilient hinge-portion defining a circumferential groove;

a gate at the second end, and a flange on the stem intermediate the button and the gate;

wherein the valve engages the shoulder at the groove; the button is adapted to be depressed and the hinge-portion is adapted, as the button is depressed, to move from a first position to a second position and, otherwise, to retain and resiliently to resume the first position; the stem extends from the button and through the rim, and moves with the hinge-portion between the first and second positions; the gate closes the distal end of the rim when the stem is in the first position; the flange closes the port when the stem is at the second position; and, both the port and the distal end are open when the stem is intermediate the first position and the second position.

7. An article comprising the device of claim 6 where the hinge-portion is of generally frusto-conical conformation, the hinge-portion defines a hinge-line, the circumferential groove is generally circular, the first aperture and the outlet aperture are generally circular and co-axial, the article includes a closure for the second aperture; and, at least some of the fingers are longer than and at least partially hedge the rim.

8. The article of claim 7 comprising also a quantity of formulation in the containment and a demountable closure for the rim.

9. The article of claim 8 where the formulation is a hair-care preparation.

10. The article of claim 8 where the formulation comprises a medicinal preparation.

* * * * *